US006901616B1

(12) United States Patent
Warrington et al.

(10) Patent No.: US 6,901,616 B1
(45) Date of Patent: Jun. 7, 2005

(54) BLANKET SUPPORT ASSEMBLY

(76) Inventors: Scott C. Warrington, 1618 Hodges Ct., Marina, CA (US) 93933; Kitty L. Warrington, 1618 Hodges Ct., Marina, CA (US) 93933

( * ) Notice: Subject to any disclaimer, the term of this patent is extended or adjusted under 35 U.S.C. 154(b) by 0 days.

(21) Appl. No.: 10/728,584

(22) Filed: Apr. 19, 2004

(51) Int. Cl.[7] ..... A47C 21/00
(52) U.S. Cl. ..... 5/505.1; 5/663
(58) Field of Search ..... 5/504.1, 505.1, 5/662

(56) References Cited

U.S. PATENT DOCUMENTS

| | | | | |
|---|---|---|---|---|
| 998,996 | A * | 7/1911 | Swenson et al. | 5/634 |
| 2,668,963 | A * | 2/1954 | Timmons | 5/505.1 |
| 3,808,614 | A * | 5/1974 | Reinhard | 5/505.1 |
| 4,214,327 | A | 7/1980 | Smith | |
| 4,570,295 | A | 2/1986 | van Mill | |
| 4,975,997 | A | 12/1990 | Misiura et al. | |
| 5,203,042 | A | 4/1993 | Mason | |
| 5,231,721 | A * | 8/1993 | Fish | 5/662 |
| 5,329,658 | A * | 7/1994 | Fontenot et al. | 5/505.1 |
| 5,337,430 | A * | 8/1994 | Schlein | 5/662 |
| D352,847 | S | 11/1994 | Station | |
| 5,881,406 | A | 3/1999 | Cobb | |
| 6,240,581 | B1 | 6/2001 | Pender | |

* cited by examiner

*Primary Examiner*—Michael Trettel

(57) ABSTRACT

A blanket support assembly includes an elongated bar with a central portion extending across a width of a bed mattress and having oppositely spaced end portions extending downwardly at a substantially orthogonal angle. The bar further includes a plurality of male members telescopically slidable within a plurality of female portions for adjusting the height of the elongated bar. The assembly further includes a pivoting mechanism including a plurality of brackets and first fastening members for selectively securing same to a bed rail. The pivoting mechanism allows an operator to pivot the bar along an arcuate path extending parallel to a longitudinal axis of a bed mattress. The pivoting mechanism may include a plurality of rollers and second fastening members attachable to the plurality of brackets and for assisting an operator to selectively slide the assembly along a bed rail to a desired position.

11 Claims, 4 Drawing Sheets

BLANKET SUPPORT ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to devices for raising the covers above a bed and, more particularly, pertains to a new adjustable blanket support device for raising the cover sheets on a bed, especially from the foot of the bed, to keep the cover sheets above the feet of a person lying on the bed under the sheets.

2. Prior Art

When bed sheets and covers are tucked in under the mattress at the foot of the bed, a sleeper's toes are often bent backwards and toes and feet become cramped because many people habitually sleep on their backs. In addition, the tossing and turning of a restless sleeper can cause the sheets to become entangled with his/her feet. Under these conditions, sleeping persons, particularly elderly people, often wake up with sore toes, feet and legs.

This problem affects a wide variety of people including, but not limited to, bed-ridden hospital patients, disabled and paralyzed persons, pregnant women, people suffering from ingrown toenails, corns, bunions and calluses, people suffering from poor circulation due to the effects of diabetes, and overweight people.

The use of devices for raising the covers above a bed is well known in the prior art. More specifically, devices for raising the covers above a bed heretofore devised and utilized are known to consist basically of familiar, expected and obvious structural configurations, notwithstanding the myriad of designs encompassed by the crowded prior art which have been developed for the fulfillment of countless objectives and requirements.

While these devices fulfill their respective, particular objectives and requirements, the aforementioned patents do not disclose a new adjustable blanket support device that can be positioned along the entire length of a bed mattress and can be hidden from view when not in use. In these respects, the adjustable blanket support device according to the present invention substantially departs from the conventional concepts and designs of the prior art, and in so doing provides an apparatus primarily developed for the purpose of raising the cover sheets on a bed, especially from the foot of the bed, to keep the cover sheets above the feet of a person lying on the bed under the sheets.

Accordingly, a need remains for a blanket support assembly that is adjustable along an entire length of a bed mattress and can be hidden from view when not in use.

BRIEF SUMMARY OF THE INVENTION

In view of the foregoing background, it is therefore an object of the present invention to provide an apparatus for raising the cover sheets on a bed to keep them above a sleeping person's feet. These and other objects, features, and advantages of the invention are provided by a blanket support assembly including an elongated bar with a central portion extending across a width of a bed mattress. Such a central portion supports a bed accessory thereon and above a top surface of a bed mattress.

The elongated bar further includes oppositely spaced end portions, integral with the central portion, and extending downwardly at a substantially orthogonal angle therefrom. The opposed end portions define a plurality of female portions. The elongated bar further includes a plurality of male members telescopically slidable within the plurality of female portions and for adjusting a height of the elongated bar.

The assembly further includes a mechanism for selectively pivoting the elongated bar. Such a pivoting mechanism includes a plurality of brackets and a plurality of first fastening members for selectively securing same to a bed rail. Advantageously, the pivoting mechanism allows an operator to pivot the bar along an arcuate path extending parallel to a longitudinal axis of the bed mattress. The plurality of brackets include a plurality of hook-shaped portions positionable over a bed rail. The pivoting mechanism includes a plurality of second fastening members for selectively passing through the plurality of male members and for securing same to the plurality of brackets, respectively. In one embodiment, the pivoting mechanism may further include a plurality of rollers attached to the plurality of brackets and engageable with a bed rail for assisting an operator to selectively slide the plurality of brackets along a bed rail.

In an alternate embodiment, the pivoting mechanism may further include a plurality of pedestals having top end portions attached to the plurality of brackets and extend downwardly therefrom, respectively. The pivoting mechanism further has bottom end portions integral with the top end portions and is positionable on a floor for providing support to the system. A plurality of stop members are removably attachable to the bottom end portions of the plurality of pedestals for assisting to maintain same at stable positions during operating conditions. Advantageously, the present invention may supported in various forms, as needed by a user.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
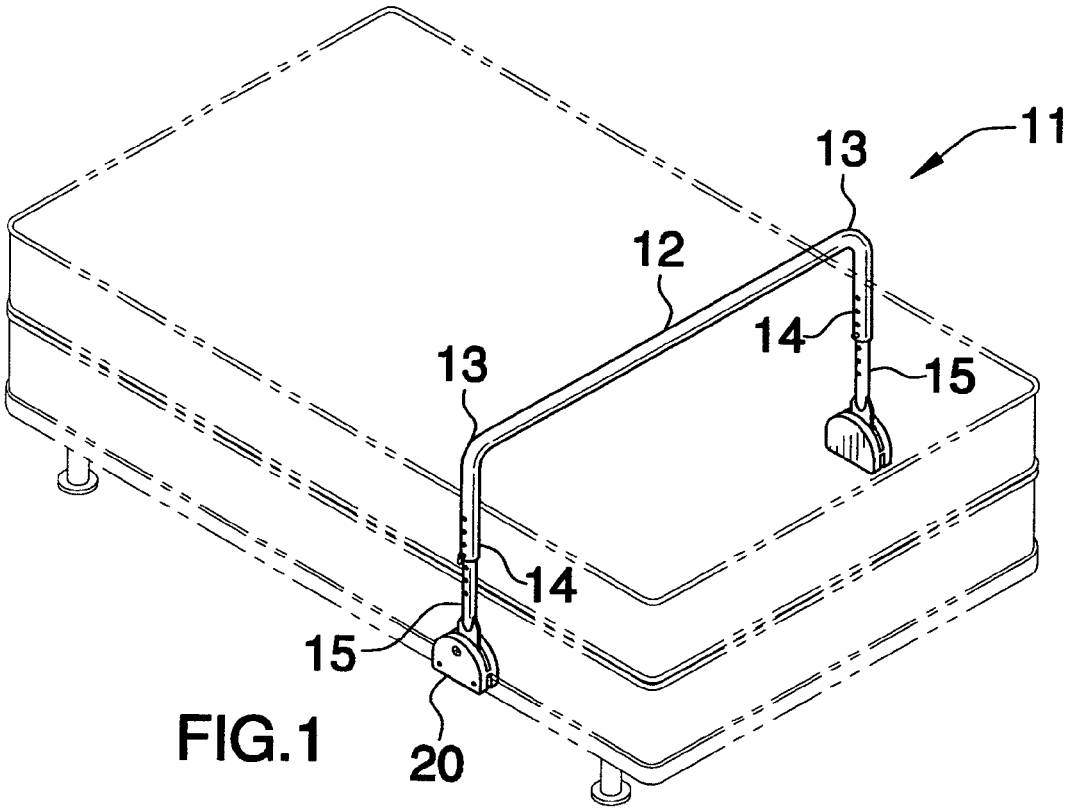
FIG. 1 is a perspective view showing a preferred embodiment of the blanket support assembly, in accordance with the present invention.
Figure 2:
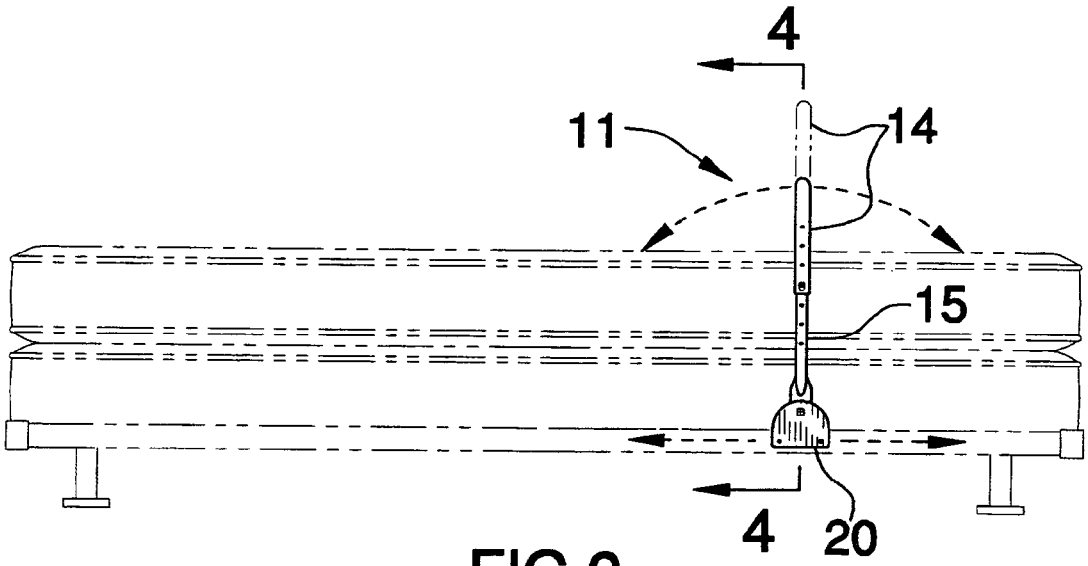
FIG. 2 is a side elevational view of the assembly shown in FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to similar elements throughout and prime and double prime numbers refer to alternate embodiments of such elements.

The assembly of this invention is referred to generally in FIGS. 1–8 by the reference numeral 10 and is intended to provide a blanket support assembly. It should be understood that the assembly 10 may be used to support many different types of material and should not be limited to supporting only bed sheets and blankets.

Referring to FIG. 1, the assembly 10 includes an elongated bar 11 having a central portion 12 extending across a width of a bed mattress and for supporting a bed accessory thereon and above a top surface of a bed mattress. The elongated bar 11 includes oppositely spaced end portions 13 integral with the central portion 12. Such end portions 13 extend downwardly at a substantially orthogonal angle from central portion 12 and define a plurality of female portions 14. The elongated bar 11 further includes a plurality of male members 15 telescopically slidable within the plurality of female portions 14 for adjusting a height of the elongated bar 11. The bar 11 is preferably formed of chrome or stainless steel to prevent cuts or scrapes from occurring on a sleeping person's feet, which may result if the bar 11 was formed of a metal not having a smooth finish. Furthermore, bar 11 is preferably formed from tubular steel so that system 10 may be readily and easily transported, as needed by a user.

Figure 3:
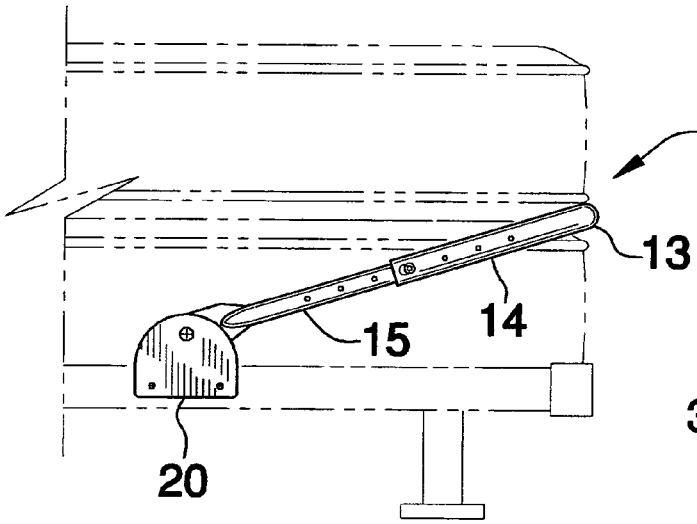
FIG. 3 is an enlarged side elevational view of the pivoting mechanism of the assembly shown in FIG. 1.
Figure 4:
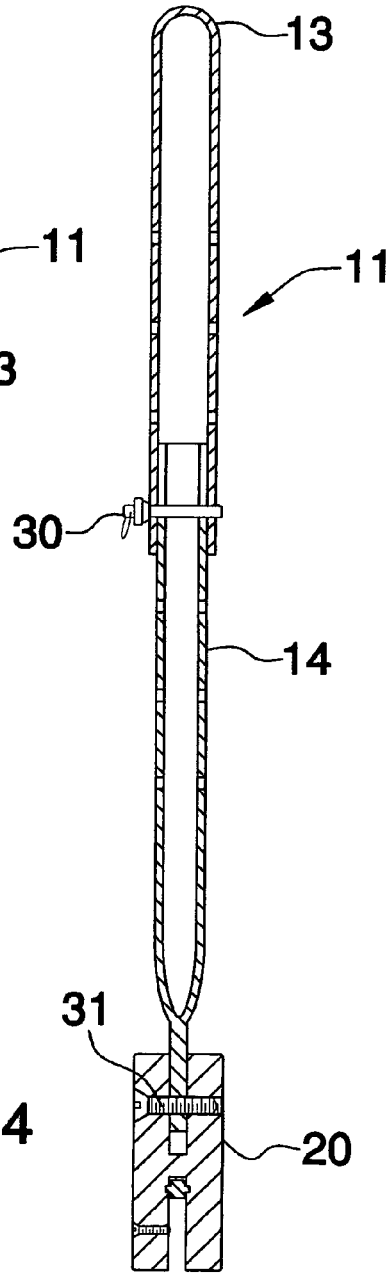
FIG. 4 is an enlarged cross-sectional view of the assembly shown in FIG. 2 taken along line 4—4.

Now referring to FIGS. 3 and 4, the assembly 10 further includes a mechanism 20 for selectively pivoting bar 11. Such a mechanism 20 includes a plurality of brackets 21 and a plurality of first fastening members 30 for selectively securing same to a bed rail. The pivoting mechanism 20 allows an operator to pivot bar 11 along an arcuate path extending substantially parallel to a longitudinal axis of the bed mattress. This allows an operator to store the bar 11 in front of the mattress when not being used, as perhaps best shown in FIGS. 3 and 5. When stored in this position, the operator can cover the bar 11 with a comforter or blanket. The pivoting mechanism 20 further includes a plurality of second fastening members 31 for selectively passing through the plurality of male members 15 and for securing same to the plurality of brackets 21, respectively, as perhaps best shown in FIG. 4. Such brackets 21 include a plurality of hook-shaped portions 23 positionable over a bed rail.

Figure 6:
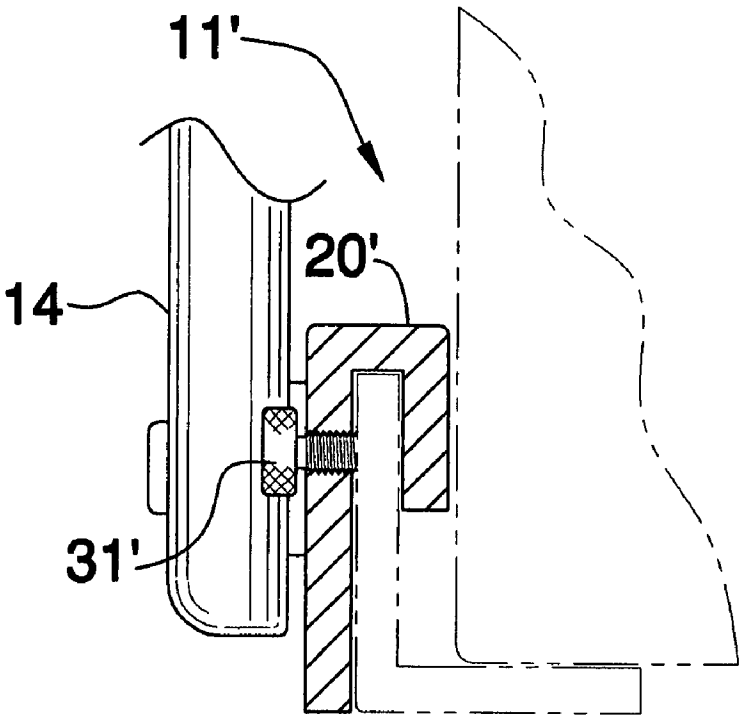
FIG. 6 is a cross-sectional view of the pivoting mechanism shown in FIG. 5 taken along line 5—5.
Figure 5:
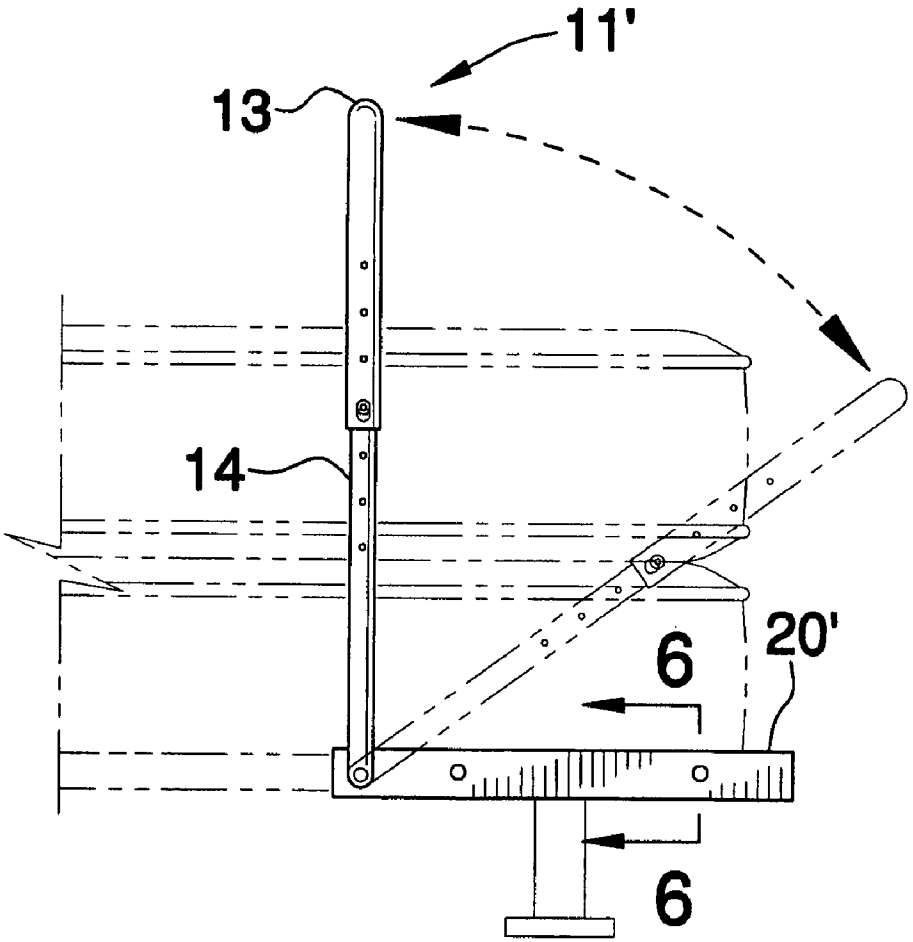
FIG. 5 is a side elevational view showing an alternate embodiment of the assembly shown in FIG. 1.
Figure 8:
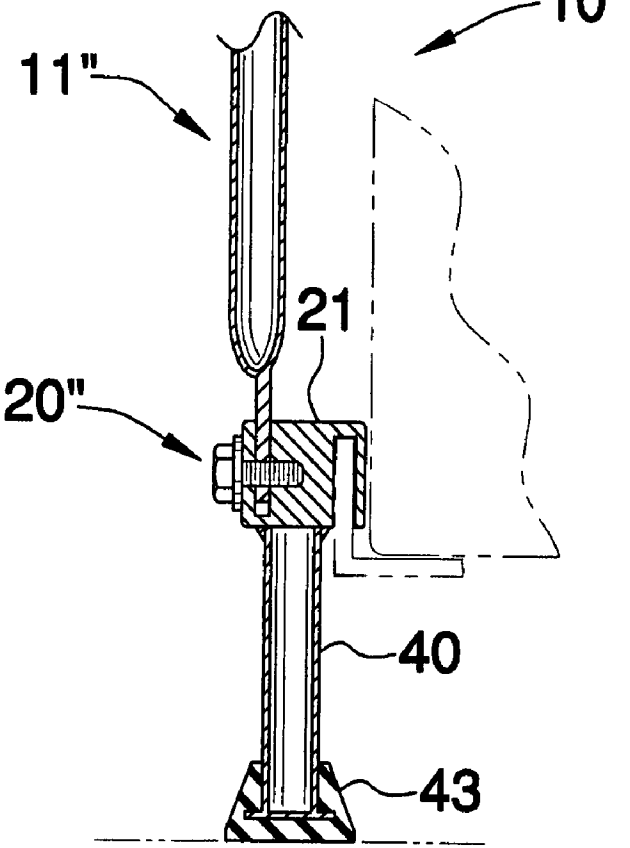
FIG. 8 is a cross-sectional view of the pedestal shown in FIG. 7 taken along line 7—7.

Now referring to FIGS. 5 and 6, an alternate embodiment of the pivoting mechanism 20' preferably includes a plurality of rollers attached to the plurality of brackets 21 shown in FIG. 8. Such rollers are engageable with a bed rail for assisting an operator to selectively slide the plurality of brackets 21 therealong. Advantageously, an operator can position the bar 11 parallel to the longitudinal axis of the mattress to accommodate a user's height.

Figure 7:
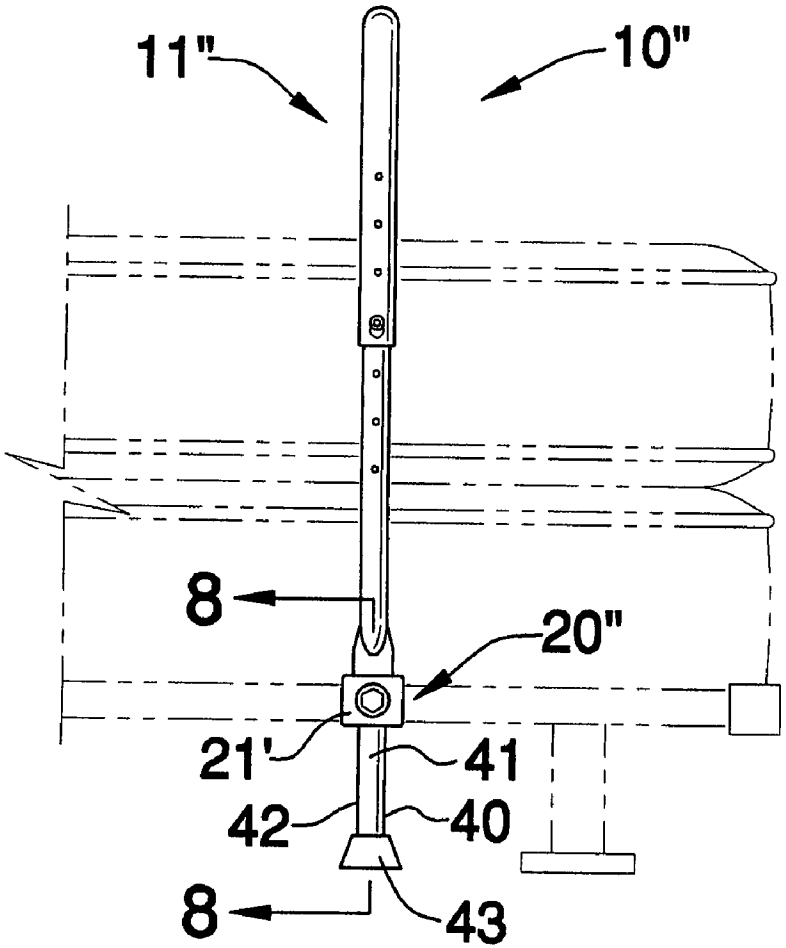
FIG. 7 is a side elevational view showing yet another embodiment of the assembly shown in FIG. 1.

Now referring to FIGS. 7 and 8, another embodiment of the pivoting mechanism 20" preferably includes a plurality of pedestals 40 having top end portions 41 attached to the plurality of brackets 21 and extending downwardly therefrom, respectively. The plurality of pedestals 40 have bottom end portions 42 integral with the top end portions 41 and positionable on a floor for providing support to the system. Such a pivoting mechanism 20" further includes a plurality of stop members 43 removably attachable to the bottom end portions 42 of the plurality of pedestals 40 for assisting to maintain same at stable positions during operating conditions. The pedestals 40 provide additional strength and support to the bar 11, enabling elderly, disabled, and overweight people to use the bar 11 as an aid when exiting the bed.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A blanket support assembly comprising:

an elongated bar including a central portion extending across a width of a bed mattress and for supporting a bed accessory thereon and above a top surface of a bed mattress, said elongated bar further including oppositely spaced end portions integral with said central portion and extending downwardly at a substantially orthogonal angle therefrom, said opposed end portions defining a plurality of female portions, said elongated bar further including a plurality of male members telescopically slidable within said plurality of female portions and for adjusting a height of said elongated bar; and means for selectively pivoting including a plurality of brackets and a plurality of first fastening members for selectively securing same to a bed rail, said pivoting means for allowing an operator to pivot said bar along an arcuate path extending parallel to a longitudinal axis of said bed mattress;

wherein said pivoting means further comprises a plurality of second fastening members for selectively passing through said plurality of male members and for securing same to said plurality of brackets respectively.

2. The assembly of claim 1, wherein said plurality of brackets include a plurality of hook-shaped portions positionable over a bed rail.

3. The assembly of claim 1, wherein said pivoting means further comprises:

a plurality of pedestals having top end portions attached to said plurality of brackets and extending downwardly therefrom respectively, said plurality of pedestals further having bottom end portions integral with said top end portions and being positionable on a floor for providing support to said system.

4. The assembly of claim 3, further comprising a plurality of stop members removably attachable to said bottom end portions of said plurality of pedestals and for assisting to maintain same at stable positions during operating conditions.

5. A blanket support assembly comprising:

an elongated bar including a central portion extending across a width of a bed mattress and for supporting a bed accessory thereon and above a top surface of a bed mattress, said elongated bar further including oppositely spaced end portions integral with said central portion and extending downwardly at a substantially orthogonal angle therefrom, said opposed end portions defining a plurality of female portions, said elongated bar further including a plurality of male members telescopically slidable within said plurality of female portions and for adjusting a height of said elongated bar; and means for selectively pivoting including a plurality of brackes and a plurality of first fastening members for selectively securing same to a bed rail, said pivoting means for allowing an operator to pivot said bar along an arcuate path extending parallel to a longitudinal axis of said bed mattress, said pivoting means further including a plurality of second fastening members for selectively passing through said plurality of male members and for securing same to said plurality of brackets respectively.

6. The assembly of claim 5, wherein said plurality of brackets include a plurality of hook-shaped portions positionable over a bed rail.

7. The assembly of claim 5, wherein said pivoting means further comprises:

a plurality of pedestals having top end portions attached to said plurality of brackets and extending downwardly therefrom respectively, said plurality of pedestals further having bottom end portions integral with said top end portions and being positionable on a floor for providing support to said system.

8. The assembly of claim 7, further comprising a plurality of stop members removably attachable to said bottom end portions of said plurality of pedestals and for assisting to maintain same at stable positions during operating conditions.

9. A blanket support assembly comprising:

an elongated bar including a central portion extending across a width of a bed mattress and for supporting a bed accessory thereon and above a top surface of a bed mattress, said elongated bar further including oppositely spaced end portions integral with said central portion and extending downwardly at a substantially orthogonal angle therefrom, said opposed end portions defining a plurality of female portions, said elongated bar further including a plurality of male members telescopically slidable within said plurality of female portions and for adjusting a height of said elongated bar; and means for selectively pivoting including a plurality of brackets and a plurality of first fastening members for selectively securing same to a bed rail, said pivoting means for allowing an operator to pivot said bar along an arcuate path extending parallel to a longitudinal axis of said bed mattress, said pivoting means further including a plurality of second fastening members for selectively passing through said plurality of male members and for securing same to said plurality of brackets respectively, said plurality of brackets including a plurality of hook-shaped portions positionable over a bed rail.

10. The assembly of claim 9, wherein said pivoting means further comprises:

a plurality of pedestals having top end portions attached to said plurality of brackets and extending downwardly therefrom respectively, said plurality of pedestals further having bottom end portions integral with said top end portions and being positionable on a floor for providing support to said system.

11. The assembly of claim 10, further comprising a plurality of stop members removably attachable to said bottom end portions of said plurality of pedestals and for assisting to maintain same at stable positions during operating conditions.

* * * * *